United States Patent [19]

Rutecki

[11] 4,412,662

[45] Nov. 1, 1983

[54] SPOOLED MATERIAL DISPENSER/HOLDER

[76] Inventor: Daniel J. Rutecki, 119 Whitley Dr., Norristown, Pa. 19403

[21] Appl. No.: 407,250

[22] Filed: Aug. 11, 1982

[51] Int. Cl.[3] ..... B65H 75/28; B65H 49/02

[52] U.S. Cl. ..... 242/125.3; 242/128; 242/157 R; 242/159

[58] Field of Search ..... 242/159, 164, 172, 128, 242/125, 125.1, 125.2, 125.3, 157 R

[56] References Cited

U.S. PATENT DOCUMENTS

| | | | |
|---|---|---|---|
| 583,176 | 5/1897 | Harvey | 242/125.3 |
| 828,922 | 8/1906 | Burtt | 242/125.3 |
| 1,336,554 | 4/1920 | Davis | 242/125.3 |
| 2,265,126 | 12/1941 | Bersche | 242/125.2 |
| 2,583,933 | 1/1952 | Elder | 242/125.2 |
| 2,963,240 | 12/1960 | Jackson et al. | 242/128 |
| 3,285,531 | 11/1966 | Gillison | 242/128 |

FOREIGN PATENT DOCUMENTS

| | | | |
|---|---|---|---|
| 65725 | 11/1969 | Fed. Rep. of Germany | 242/128 |
| 225706 | 12/1924 | United Kingdom | 242/125.3 |

*Primary Examiner*—Stanley N. Gilreath

[57] ABSTRACT

A device for dispensing and holding materials wound on a spool having a contoured peripheral edge on a spool end or spool end flange comprising a congruent, self-lubricious member capable of bi-directional movement along the contoured peripheral edge with a predetermined amount of frictional resistance. The member incorporating a material dispensing aperture congruently contoured to the cross-sectional profile of the material thru which the material is dispensed with a predetermined amount of frictional resistance. The member moving along the contoured peripheral edge when the spooled material is pulled away from the plane of the spool end or the spool end flange and generally parallel to the spool core axis during the dispensing process. When the pulling force on the material is halted, the dispensing ceases and the material can then be severed near the member. The end of the material being held securely by the combined "holding force" of the material dispensing aperture on the spooled material and the member being held frictionally secure to the contoured peripheral edge thereby preventing the remaining layers of spooled material from loosening into a disorderly state and also holding the spooled material end ready for future access. The member being readily transferred from spool to spool by simply "snapping" it "off" the contoured peripheral edge of one spool end or spool end flange and then "snapping" it "onto" or "into" the contoured peripheral edge of another spool end or spool end flange.

2 Claims, 7 Drawing Figures

SPOOLED MATERIAL DISPENSER/HOLDER

BACKGROUND

My invention relates to spooled material and the fact that all materials wound and sold on a spool eventually degrade into a state of disarray. Spooled materials for example such as: electrical wire, thread, fishing lines, cordage, wire cable, metallic and plastic filaments, string, wire solder, plastic tubing, and sleeving and countless other materials too numerous to list are sold on spools without any efficient means to controllably dispense the material or adequately hold the uncoiled end of the spooled material to prevent the remaining layers of spooled material from loosening and becoming entangled and disorderly.

SUMMARY

My invention is designed to eliminate the above problems by providing a means for the controlled dispensing and holding of spooled material and utilizes a contoured peripheral edge of a spool end or a spool end flange to retain and guide a frictionally attached movable member which incorporates an appropriately contoured material dispensing aperture congruent to the cross-sectional profile of the spooled material. This frictionally attached movable member is fabricated or molded of a lubricitous material such as teflon, nylon, delrin or any other material having the desirable characteristics of self-lubricity, adequate strength and sufficient flexibility. This movable member is capable of bi-directional movement and can move continuously along the contoured peripheral edge of a spool end or a spool end flange either by utilizing the external surface profile of the contoured peripheral edge of a spool end or a spool end flange, or the internal surface profile of a contoured circumambient groove or the like incorporated within the contoured peripheral edge of a spool end or a spool end flange or any combination thereof. The surface contact area between the retaining and guiding profile of the contoured peripheral edge of a spool end or a spool end flange and the congruent portion of the movable member is designed to provide a "clamping" or "holding" force between the two surfaces allowing the movable member to move with a predetermined amount of frictional resistance.

When the external surface of the contoured peripheral edge of a spool end or a spool end flange is utilized as a retaining profile the movable member incorporates a congruently contoured retaining aperture allowing it to be snapped "onto" the contoured peripheral edge of a spool end or a spool end flange and inversely, if the internally contoured surface profile of a circumambient groove or the like contained within the contoured peripheral edge of a spool end or a spool end flange is utilized as a retaining aperture the movable member then incorporates a congruently contoured, external surface retaining profile that allows it to be snapped "into" the said circumambient groove. The determining factors in the design of the spooled material dispenser/-holder in the form of the aforementioned movable member are; the cross-sectional retaining profile of the contoured peripheral edge on a specific type of spool as produced by hundreds of spool manufacturers and also the cross-sectional profile of the thousands of materials in unlimited shapes, types and characteristics that are capable of being wound and sold on a spool. The impossibility of designing a universal spooled material dispenser/holder for use with all types of spools and materials is obvious.

PRIOR ART

Prior art has disclosed no reference to the unique method of dispensing spooled material utilizing a contoured peripheral edge of a spool end or a spool end flange in combination with a frictionally attached, congruently contoured, retained, movable, self-lubricious, material dispensing/holding member.

Most prior art references employ a central structural support extending through the spool core on which a central pivot point and lubricated bearing are located to support a rotatable arm or similar member extending beyond the edge of the spool and having a hole or loop through which the spooled material is uncoiled. Speed of the rotating devices being controlled by brakes or clutches.

My invention eliminates most of the above named components incorporated in the prior art.

OBJECTIVES OF THIS INVENTION

It is therefore an object of my invention to provide a unique, simple, economic and efficient spooled material dispenser/holder that is frictionally attached to the contoured peripheral edge of a spool end or spool end flange.

It is another object of my invention to provide a spooled material dispenser/holder requiring no external lubrication.

It is yet another object of my invention to provide a spooled material dispenser/holder that prevents the remaining spooled material from loosening into a disorderly state.

Another object of my invention is to provide a spooled material dispenser/holder that holds the uncoiled end of the spooled material strand in a secure position for ready access.

Yet another object of my invention is to provide a compact, reusable spooled material dispenser/holder that can be easily transferred from spool to spool.

REFERENCE TO DRAWINGS

DESCRIPTION

Figure 1:
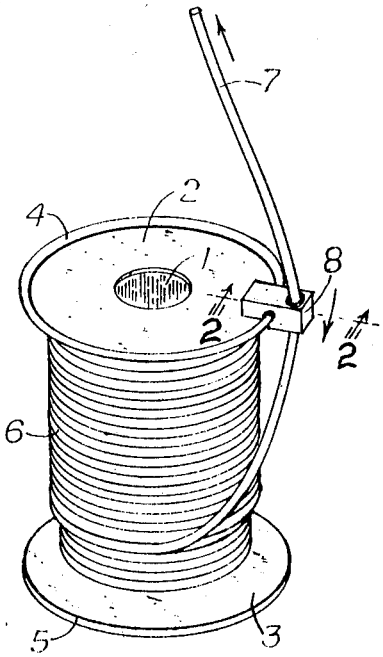
FIG. 1 is a perspective view of a spool of wire solder with the spooled material dispenser/holder frictionally attached to the externally contoured peripheral edge of the wire solder spool end flange illustrating the operating principle of the dispensing process.
Figure 2:
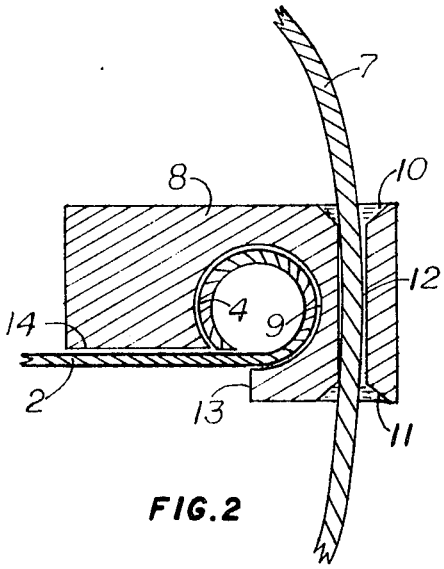
FIG. 2 is a view of the cross-sectional area on the plane indicated by 2—2 in FIG. 1.
Figure 3:
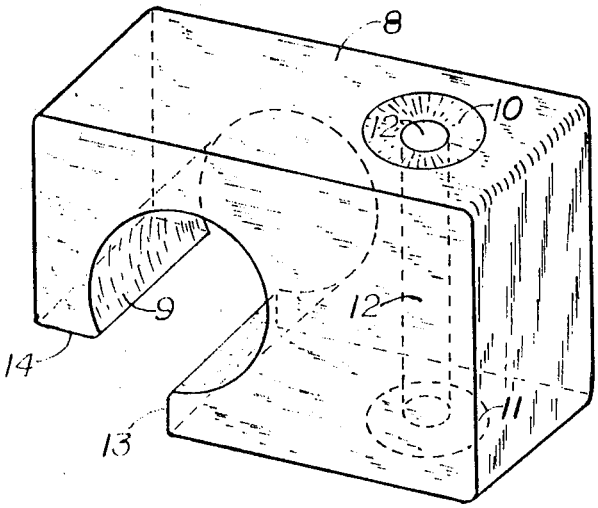
FIG. 3 is an enlarged, isometric detailed view of the spooled material dispenser/holder in an elemental form with the retaining and dispensing apertures designed specifically to be congruent with both the contoured peripheral edge of the metal wire solder spool end flange and the cross-sectional profile of the wire solder strand.

Embodiment of FIGS. 1 thru 3

Herein follows a detailed description of an embodiment of my invention and the operating principle of the spooled material dispenser/holder when utilized on a commercially available spool of wire solder material.

FIG. 1 illustrates a perspective view of a spool of wire solder comprising a central spool core 1 with the upper spool end flange 2 and lower spool end flange 3. The upper spool end flange contoured peripheral edge 4 and the lower spool end flange contoured peripheral edge 5 are identical and are formed by rolling the edge of the metal spool end flange plates 2 and 3 into a spherically shaped bead by the spool manufacturer forming an external retaining profile at 4 as shown in cross-sectional detail in FIG. 2. The spooled material dispenser in the form of the lubricious movable member 8 as shown in magnified detail in FIG. 3 is frictionally attached to the contoured peripheral edge 4 of the spool end flange 2 by the spreading of the slotted retaining aperture 9 when "snapping" the movable member 8 "onto" the externally contoured peripheral edge 4 as depicted in FIG. 1 and the cross-sectional view of FIG. 2. The retaining aperture 9 which is incorporated within the movable member 8 is made to be closely congruent with the contoured peripheral edge 4 and has enough intimate contact to provide a predetermined amount of frictional resistance to movement. The end of the wire solder strand 7 is passed through the movable member 8 starting through the bottom inlet chamfer 11 of the material dispensing aperture 12 and exiting at the outlet chamfer 10 of the material dispensing aperture 12. The wire solder strand 7 is then pulled upwards, as shown by the arrow in FIG. 1, and away from the plane of the spool end flange 2 and generally parallel to the spool core 1 axis, causing the movable member 8 to move along the contoured peripheral edge 4 of the spool end flange 2 in the direction of the arrow shown in FIG. 1 as the wire solder strand 7 is uncoiled from the spool and dispensed through the material dispensing aperture 12. As the wire solder strand 7 passes through the material dispensing aperture 12 which is a hole of slightly larger diameter than the diameter of the wire solder, the curved wire solder as formed by the radius of the wound layers on the spool is "straightened" and in the process generates a sufficient amount of frictional resistance to prevent it from slipping out of the material dispensing aperture 12 when it is severed near the outlet chamfer 11 of the material dispensing aperture 12. Owing to the ductility of the wire solder itself, it can be bent at the outlet chamfer 11 of the material dispensing aperture 12, preventing it from slipping out of the material dispensing aperture 12. Other materials or smaller diameters of wire solder strands may require an undersized slotted hole or an appropriately designed slot or aperture to provide an adequate holding force as will be described later. The advantages of the spooled material dispenser/holder are more readily apparent when working with very small diameter wire solders which are very flexible and cause considerable difficulty in securing or positioning the end of the wire solder strand. Wire solders of 0.030 of an inch diameter or smaller are simply pulled out an inch or two at a time and are held in a secure position by the holding force of the material dispensing aperture 12 and also the frictional contact between the retaining aperture 9 and the external retaining profile of the contoured peripheral edge 4 of the spool end flange 2. The secure wire solder strand is thereby made readily accessible to be touched by a hot soldering iron for the purpose of adding molten solder to the soldering iron tip.

When required, several inches or many feet of wire solder can be dispensed from the wire solder spool with the remaining spooled material being maintained in an orderly state.

The enlarged, isometric view of FIG. 3 shows the elemental form of the spooled material dispenser/-holder as a rectangular block of teflon or other self-lubricious material with the retaining aperture 9 being a hole of slightly smaller diameter than the spherically contoured peripheral edge 4 of the spool end flange 2 with the lower left quadrant material section removed at points 13 and 14. The spool and flange contact section at 14 being a slightly shorter version than depicted in FIG. 2.

FIG. 3 also shows the outlet of the material dispensing aperture 12 as being a through hole indicated by the 12 between the dotted lines and also shown is the inlet chamfer 11 on the bottom and the outlet chamfer 10 at the top to facilitate the passage of the wire solder strand through the material dispensing aperture 12.

DESCRIPTION

Embodiments of FIGS. 4 thru 7

Figure 4:
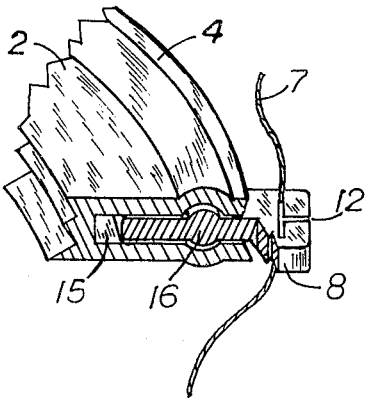
FIG. 4 is an enlarged, perspective, fragmentary and cross-sectional view illustrating an embodiment of this invention as it may be applied to small diameter filamentary strands or threads on molded plastic spools.
Figure 5:
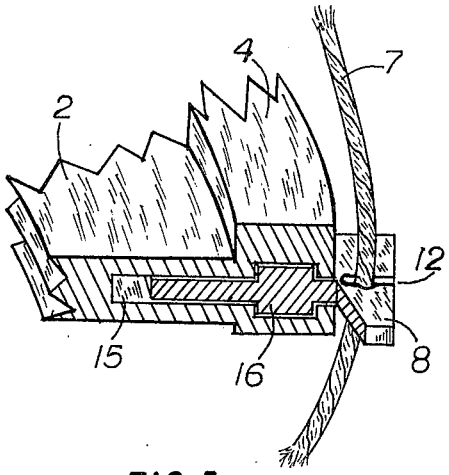
FIG. 5 is an enlarged, perspective, fragmentary and cross-sectional view illustrating an embodiment of this invention as may be utilized on larger diameter strands of cordage.

FIG. 4 illustrates an enlarged, perspective, fragmentary and cross-sectional view of an embodiment of this invention comprising a spool end flange 2 and a contoured peripheral edge 4 into which an internally contoured, spheroidal, circumambient groove 15 is incorporated. The movable member 8 has a congruently contoured external profile 16 which is "inserted" or "snapped" into the said groove 15 and provides a predetermined amount of frictional resistance through the proper degree of mutual contact between the congruent profiles 15 and 16. The said movable member 8 also incorporating an appropriate "T" slot material dispensing aperture 12 for the threadlike spooled material strand 7 being dispensed. The top portion of the "T" slot is narrower than the diameter of the spooled material strand 7 thereby providing a predetermined amount of frictional resistance on the dispensing strand 7 and also allowing the said strand 7 to be dispensed from either end of the slot depending on the directional winding of the spooled material when only one spool end contains the said groove 15.

FIG. 15 illustrates an enlarged, perspective, fragmentary and cross-sectional view of basically the same embodiment as in FIG. 4 except that the externally contoured peripheral edge 4 of the spool end flange 2 and the internally contoured circumambient groove 15 and the congruent external profile 16 of the movable member 8 are of a squarish design. The material dispensing aperture 12 in the form of a slotted hole of slightly smaller diameter than the spooled material corded strand 7, is efficiently utilized to impart the required amount of frictional resistance on the corded strand 7 of the spooled material, to prevent it from slipping out of the material dispensing aperture 12 after being severed.

Figure 6:
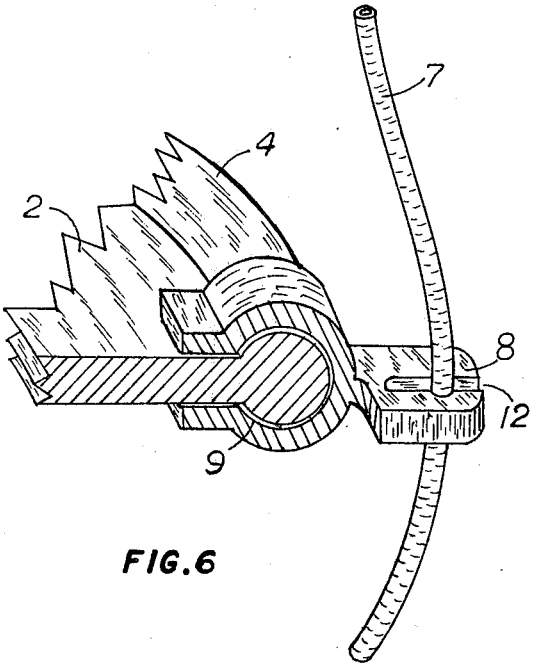
FIG. 6 is an enlarged, perspective, fragmentary and cross-sectional view illustrating the simplest and most economical embodiment of this invention as applied to a general variety of spooled material.

FIG. 6 illustrates an enlarged, perspective, fragmentary and cross-sectional view of the simplest and most economical embodiment of this invention as would apply to the majority of spooled materials due to the simplicity of the basic design of the frictionally attached movable member 8 with the retaining aperture 9 and the material dispensing aperture 12 being formed by a molding process thus eliminating excess material or the loss of material thru other manufacturing processes. The spool end flange 2 contains a spheroidal externally contoured profile on the peripheral edge 4 and is a standard shape utilized by many spool manufacturers. The slotted hole type of material dispensing aperture 12 would also be applicable to a great variety of spooled materials.

Figure 7:
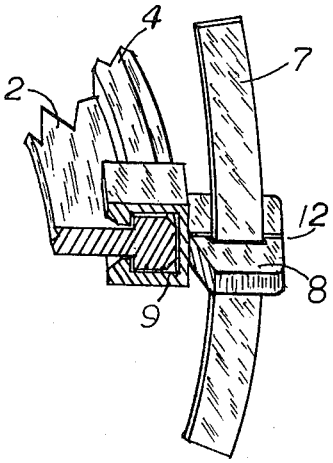
FIG. 7 is an enlarged, perspective, fragmentary and cross-sectional view illustrating an embodiment of this invention with a dispensing aperture congruent to a ribbon type of spooled material.

FIG. 7 is yet another embodiment of my invention whereby the spool end flange 2 contains a squarishly contoured external profile on the peripheral edge 4 of the spool end flange 2 and is matched by the congruently contoured retaining aperture 9 of the movable member 8. The material dispensing aperture 12 is congruently contoured to permit dispensing a ribbonlike strand 7 of spooled material.

DESIGN CRITERIA FOR THE SPOOLED MATERIAL DISPENSER/HOLDER

As can readily be ascertained, the design of the Spooled Material Dispenser/Holder movable member is solely determined by the retaining profile of the contoured peripheral edge of a spool end or a spool end flange and the physical size, cross-sectional shape, flexibility and other characteristics of the material contained on the spool. The design variations of the movable member are thus made limitless.

I claim:

1. A spooled strand material dispenser/holder comprising a central spool core, said central spool core having integrally attached spool ends or spool end flanges, each said integrally attached spool end or spool end flange having a contoured peripheral edge, a self-lubricious movable member incorporating a congruently contoured retaining aperture or retaining profile frictionally attached and retained on a said contoured peripheral edge, said congruently contoured retaining aperture or retaining profile providing means by which the said movable member is frictionally attached to and guided by the said contoured peripheral edge of a spool end or a spool end flange, thereby providing means by which the said movable member can move along bi-directionally and continuously along the said contoured peripheral edge of the spool end or spool end flange with a predetermined amount of frictional resistance, said movable member also incorporating a congruently contoured material dispensing aperture, said congruently contoured material dispensing aperture allowing the passage therethrough of the spooled strand material with a predetermined amount of frictional resistance when the said spooled strand material is pulled away from the plane of the spool end or spool end flange and generally parallel to the said central spool core axis causing the said movable member to move along the said contoured peripheral edge of the said spool end or spool end flange thereby dispensing the said spooled strand material from the said spool central core as required and whereas when the pulling force on the spooled strand material is halted and the said spooled strand material is severed near the outlet of the said congruently contoured material dispensing aperture, the said spooled strand material end is held in tension by the dispensing aperture within the movable member, the said movable member being also held in position on the said contoured peripheral edge of the said spool end or spool end flange by a sufficiently intimate contact between the said contoured peripheral edge of the said spool end or spool end flange and the said congruently contoured retaining aperture or retaining profile of the said movable member thereby preventing the loosening of the remaining spooled material into a disorderly state while also holding the end of the said strand material for ready access, the said movable member also being transferrable from spool to spool.

2. A spooled strand material dispenser/holder comprising a member of self-lubricious material such as teflon, nylon, delrin or the like, the said member incorporating a congruently contoured retaining aperture or retaining profile providing means by which the said member may be frictionally attached to and retained by a congruently contoured peripheral edge of a spool end or spool end flange, the said member being capable of bi-directional and continuous movement along the congruently contoured peripheral edge of the spool end or spool end flange with a predetermined amount of frictional resistance, the said frictionally movable member also incorporating a congruently contoured material dispensing aperture, the said congruently contoured material dispensing aperture allowing the passage therethrough of spooled strand material with a predetermined amount of frictional resistance when the said spooled strand material is pulled away from the plane of the spool end or the spool end flange and generally parallel to a cenral spool core axis causing the said frictionally movable member to move along the said contoured peripheral edge of the spool end or spool end flange thereby dispensing the said spooled strand material as required and whereas when the pulling force on the spooled strand material is halted and the said spooled strand material is severed near the outlet of the said congruently contoured material dispensing aperture, the said spooled strand material end is held in tension by the congruently formed material dispensing aperture within the said frictionally movable member, the said frictionally movable member being also held in position on the said contoured peripheral edge of the said spool end or spool end flange by a sufficiently intimate contact between the said contoured peripheral edge of the said spool end or spool end flange and the said congruently contoured retaining aperture or retaining profile of the said frictionally movable member thereby preventing the loosening of the remaining spooled material into a disorderly state while holding the end of the said strand material for ready access, the said frictionally movable member also being transferrable from spool to spool.

* * * * *